US009255528B2

(12) United States Patent
Jeong

(10) Patent No.: US 9,255,528 B2
(45) Date of Patent: Feb. 9, 2016

(54) SYSTEM AND METHOD FOR CONTROLLING AN EXHAUST BRAKE OF A VEHICLE

(75) Inventor: Jong Yun Jeong, Wanju-gun (KR)

(73) Assignee: Hyundai Motor Company, Seoul (KR)

( * ) Notice: Subject to any disclaimer, the term of this patent is extended or adjusted under 35 U.S.C. 154(b) by 734 days.

(21) Appl. No.: 13/610,257

(22) Filed: Sep. 11, 2012

(65) Prior Publication Data

US 2013/0104841 A1 May 2, 2013

(30) Foreign Application Priority Data

Oct. 28, 2011 (KR) ..... 10-2011-0111422

(51) Int. Cl.
*F02D 9/06* (2006.01)
*F02D 41/12* (2006.01)

(52) U.S. Cl.
CPC *F02D 9/06* (2013.01); *F02D 41/12* (2013.01); *F02D 2200/101* (2013.01)

(58) Field of Classification Search
CPC ..... F02D 9/06; F02D 41/12; F02D 2200/101
USPC ..... 123/323
See application file for complete search history.

(56) References Cited

U.S. PATENT DOCUMENTS

| | | | | |
|---|---|---|---|---|
| 6,202,780 | B1 * | 3/2001 | Tanaka et al. | 180/179 |
| 6,273,058 | B1 * | 8/2001 | Wagner | 123/323 |
| 6,810,850 | B2 * | 11/2004 | Anderson et al. | 123/323 |
| 6,899,079 | B1 * | 5/2005 | Hill et al. | 123/323 |
| 7,765,981 | B2 * | 8/2010 | Lhote et al. | 123/323 |
| 7,802,424 | B2 * | 9/2010 | Kanzawa et al. | 60/324 |
| 2011/0031425 | A1 * | 2/2011 | Tyler | 251/129.11 |

FOREIGN PATENT DOCUMENTS

| | | | |
|---|---|---|---|
| JP | 9-13995 | A | 1/1997 |
| JP | 10-153133 | A | 6/1998 |
| KR | 100180467 | B1 | 12/1998 |
| KR | 10-2004-0034844 | A | 4/2004 |

* cited by examiner

*Primary Examiner* — Erick Solis
(74) *Attorney, Agent, or Firm* — Morgan, Lewis & Bockius LLP

(57) ABSTRACT

A system and method for controlling an exhaust brake of a vehicle may measure rotation speed (RPM) of an engine, transmit the rotation speed of the engine to a control unit, determine an opening of a valve which opens/closes an exhaust pipe of the engine in the control unit based on the rotation speed of the engine to maintain the back pressure of exhaust gas generated by the exhaust brake to be constant, and control the valve according to the valve opening determined by the control unit.

6 Claims, 2 Drawing Sheets

SYSTEM AND METHOD FOR CONTROLLING AN EXHAUST BRAKE OF A VEHICLE

CROSS-REFERENCE TO RELATED APPLICATION

The present application claims priority to Korean Patent Application No. 10-2011-0111422 filed in the Korean Intellectual Property Office on Oct. 28, 2011, the entire contents of which is incorporated herein for all purposes by this reference.

BACKGROUND OF THE INVENTION

1. Field of the Invention

The present invention relates to a system and method for controlling an exhaust brake of a vehicle. More particularly, the present invention relates to a system and method for controlling an exhaust brake of a vehicle that improves a low and medium speed of an engine and prevents damage to vehicle components by maintaining back pressure of the exhaust brake to be constant at any rotation speed of the engine.

2. Description of Related Art

Generally, commercial vehicles such as trucks have an exhaust brake supporting a main brake such as a footbrake. The exhaust brake degrades the engine operation by forcibly suppressing exhaust gas which is released into the atmosphere after burning inside an exhaust pipe communicating with an exhaust manifold.

The conventional exhaust brake for vehicles has a butterfly valve equipped at an exhaust system of engine for controlling an exhaust gas flow. If the butterfly valve is closed, then back pressure is generated by shutting off the exhaust pipe and the engine speed is reduced by rotational resistance of the crank shaft, and as a result the vehicle slows down.

In this case, a hole might be formed in the butterfly valve so as to satisfy permissible back pressure, and the performance of the exhaust brake can be fine-tuned by adjusting the size of the hole.

However, the conventional exhaust brake has a problem of performance degradation at low and medium engine speeds such as the main speed of an engine by fixing the valve opening of the exhaust brake so as to maintain the back pressure below the permissible back pressure at a maximum rotation speed of the engine.

The conventional exhaust brake has a further problem that components of the engine can be damaged by excessive back pressure caused by an excessively high engine speed, because the opening of the butterfly valve is constantly maintained even when the engine speed is excessively high.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a system and method for controlling an exhaust brake of a vehicle having advantages of improving performance of the exhaust brake at low and medium engine speeds, and preventing damage to the engine components by constantly maintaining back pressure of the exhaust brake at any engine speed.

In an aspect of the present invention, a system for controlling an exhaust brake of a vehicle, may include a measuring unit of measuring a rotation speed (RPM) of an engine, a valve unit connected to an exhaust pipe of the engine, an actuator connected to the valve unit and controlling an opening amount of the exhaust pipe, and a control unit of controlling the actuator to control the opening amount of the valve unit, wherein the control unit controls the actuator based on a rotation speed of the engine measured by the measuring unit to maintain a back pressure of an exhaust gas generated by the exhaust brake to be constant.

The actuator is a motor connected to the valve unit, and wherein the control unit controls the opening amount by controlling a rotation of the motor.

The control unit is an electronic control unit (ECU).

The valve unit may include a first worm directly connected to and rotating with a rotating shaft of the motor, a second worm engaged with the first worm and moving back or forth by a rotation of the first worm, and a valve body connected to the second worm and disposed at an end of the exhaust pipe to control the opening amount of the exhaust pipe by moving the valve body back or forth.

The valve unit may include a butterfly valve, a rotating shaft of the butterfly valve is connected to a rotating shaft of the motor, and the control unit controls an opening of the butterfly valve by controlling the rotation of the motor.

The control unit maintains the back pressure of the exhaust gas to be constant by controlling the opening amount in proportion to the rotation speed of the engine.

In another aspect of the present invention, a method for controlling an exhaust brake of a vehicle, may include measuring a rotation speed (RPM) of an engine, transmitting the rotation speed of the engine to a control unit, determining an opening amount of a valve unit which opens or closes an exhaust pipe of the engine in the control unit based on the rotation speed of the engine to maintain a back pressure of exhaust gas generated by the exhaust brake to be constant, and controlling the valve unit according to the opening amount determined by the control unit.

The controlling of the valve unit is performed by controlling rotation of a motor connected to the valve unit by the control unit.

The control unit maintains the back pressure of the exhaust gas to be constant by controlling the opening amount in proportion to the rotation speed of the engine.

The system and method for controlling an exhaust brake of a vehicle according to an exemplary embodiment of the present invention has an effect of improving performance of the exhaust brake at low and medium engine speeds through constantly maintaining back pressure at any engine speed.

Further, the system and method for controlling an exhaust brake of a vehicle according to an exemplary embodiment of the present invention has an effect of preventing damage to the engine components by constantly maintaining back pressure of the exhaust brake at any engine speed.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
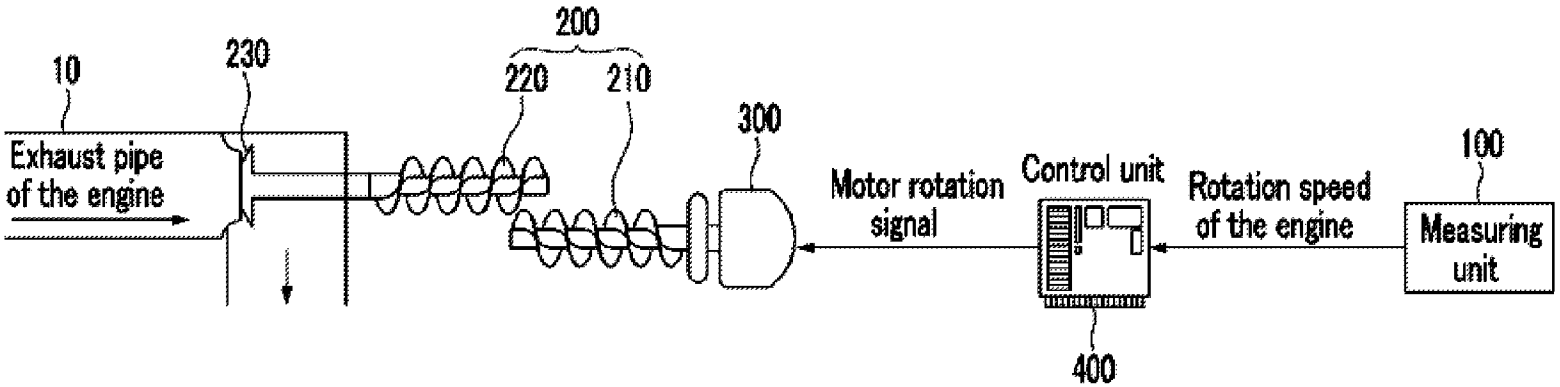
FIG. 1 is a schematic diagram of a system for controlling an exhaust brake of a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

As shown in FIG. 1, a system for controlling an exhaust brake of a vehicle may include a measuring unit 100 for measuring rotation speed (RPM) of an engine, a valve 200 connected to an exhaust pipe 10 of the engine and controlling an opening of the exhaust pipe, and a control unit 400 for controlling a valve opening.

The control unit 400 maintains the back pressure of the exhaust brake measured by the measuring unit 100 to be constant by controlling the opening of the valve 200.

The valve 200 is mounted on the exhaust brake for controlling an exhaust gas flow of an exhaust system of the engine. The back pressure is generated when the exhaust pipe is blocked by closing of the valve 200, and a rotational resistance is created by the back pressure such that the speed of the engine and the vehicle slows.

The measuring unit 100 measures the rotation speed (RPM) of the engine. Generally, the rotation speed of the engine can be measured by mounting a sensor to the transmission of the vehicle. In another method, the rotation speed of the engine can be measured by wirelessly detecting electromagnetic waves generated by a power stroke of the engine using an RPM pick-up sensor. The rotation speed of the engine can be measured in various methods, therefore a method for measuring rotation speed of the engine is not limited by the above methods.

The rotation speed of the engine measured by the measuring unit 100 is transmitted to the control unit 400.

The control unit 400 receives the rotation speed of the engine from the measuring unit 100 and controls the valve 200 of the exhaust brake to maintain exhaust pressure of the exhaust brake to be constant on the basis of the rotation speed of the engine.

The control unit 400 may be an electronic control unit (ECU) of the vehicle.

Exhaust pressure of the exhaust brake may be influenced by the rotation speed of the engine.

A higher rotation speed (RPM) of the engine produces a larger exhaust pressure than a lower rotation speed (RPM) of the engine, even when the opening of the valve 200 of the exhaust brake is the same.

Generally, the performance of the exhaust brake improves as the exhaust pressure increases. But in the case of the conventional exhaust brake, the opening of the valve is fixed regardless of the rotation speed of the engine. As a result the performance of the exhaust brake was degraded at a low engine rotation speed since low back pressure is formed by the fixed opening of the valve. Further, the conventional exhaust brake has a problem that the components of the engine can be damaged by an excessively high exhaust pressure when the rotation speed of the engine is high.

An exemplary embodiment of the present invention changes the opening of the valve 200 of the exhaust brake according to the rotation speed of the engine received from the control unit 400, so as to solve the above-mentioned problem of the conventional art.

The opening of the valve 200 can be controlled using various methods. In one or a plurality of exemplary embodiments, as shown in FIG. 1, The system may include a motor 300 connected to the valve 200, a first worm 210 directly connected to and rotating with a rotating shaft of the motor 300, a second worm 220 moving back and forth by being engaged with the first worm 210, and a valve body 230 connected to the second worm 220 so as to control the opening of the valve 200.

The control unit 400 calculates the opening of the valve 200 and the rotation speed of the motor 300 on the basis of the rotation speed of the engine so as to maintain the exhaust pressure to be constant.

The first worm 210 rotates when the motor 300 is controlled by the calculation of the control unit 400 and the second gear 220 moves back or forth by being engaged with the first worm 210.

The moving directions of the second worm 220 such as back and forth may be controlled by controlling the rotation direction of the motor 300, and the opening of the valve may be controlled by controlling the number of rotations the motor 300.

The second worm gear 220 may move forth when the motor rotates in one direction by controlling of the control unit 400 and the valve body 230 slowly shuts the exhaust pipe 10. As a result, back pressure of the exhaust brake increases. The second worm gear 220 may move back when the motor rotates in the opposite direction by controlling of the control unit 400 so the valve body 230 opens the exhaust pipe 10. As a result, back pressure of the exhaust brake decreases.

In one or a plurality of exemplary embodiments, the control unit 400 calculates the opening value of the valve 200 according to the rotation speed of the engine and stores the opening value in advance. The control unit 400 controls the position of the valve 200 according to the stored opening value when the control unit receives rotation speed information of the engine.

The opening of the valve may be controlled in various ways according to the type of the valve 200. Another type of gear may be used for controlling the opening of the valve body 230 without using the two worms 210 and 220.

In one or a plurality of exemplary embodiments, the valve 200 of the exhaust brake may be a butterfly valve and the motor 300 may be connected to the rotating shaft of the motor 300. The control unit 400 changes the opening of the valve 200 by controlling rotation of the motor 300. The control unit 400 may control the opening of the butterfly valve 200 using pneumatic or hydraulic pressure.

As a method for controlling back pressure of the exhaust brake, the control unit 400 controls the opening of the valve 200 in proportion to the rotation speed of the engine so as to maintain the back pressure of the exhaust brake.

The control unit 400 controls the opening of the valve 200 to be smaller when the rotation speed of the engine decreases so as to increase back pressure, and controls the opening of the valve 200 to be larger when the rotation speed of the engine increases so as to decrease the back pressure such that it can be maintained to be constant.

Therefore, the system for controlling an exhaust brake of a vehicle according to an exemplary embodiment of the present invention has an effect of improving performance of the exhaust brake at low and medium engine speeds through constantly maintaining the back pressure, and protecting components of the engine by preventing excessive back pressure at a high engine speed.

A method for controlling an exhaust brake of a vehicle according to an exemplary embodiment of the present invention will hereinafter be described in detail with reference to the accompanying drawings.

Figure 2:
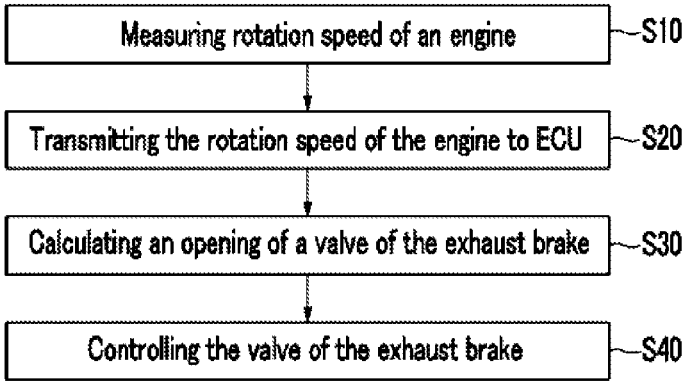
FIG. 2 is a flowchart of a method for controlling an exhaust brake of a vehicle according to an exemplary embodiment of the present invention.

A method for controlling an exhaust brake of a vehicle according to an exemplary embodiment of the present invention, as shown in FIG. 2, may include measuring the rotation speed (RPM) of an engine at step S10, transmitting the rotation speed of the engine to a control unit 400 at step S20, calculating an opening of a valve which opens/closes an exhaust pipe of the engine in the control unit 400 based on the rotation speed of the engine to maintain the back pressure of exhaust gas generated by the exhaust brake to be constant at step S30, and controlling the valve according to the valve opening calculated by the control unit 400 at step S40.

At the step S10, the rotation speed of the engine is measured using measuring unit 100 such as a sensor when the exhaust brake operates. In one or more exemplary embodiments, the rotation speed of the engine may be measured by mounting a sensor which detects the rotation speed of the engine to a transmission of the vehicle or by using an RPM pick-up sensor which wirelessly detects electromagnetic waves generated by the power stroke of the engine.

The rotation speed measured at the step S10 is then transmitted to the control unit 400 such as an electronic control unit (ECU) at the step S20.

The control unit 400 calculates an opening of the valve 200 of the exhaust brake on the basis of the received rotation speed of the engine at the step S30.

The control unit 400 may calculate an opening value of the valve 200 in proportion to the rotation speed of the engine so as to maintain the back pressure of the exhaust brake.

Further, the control unit 400 controls the opening of the valve using the above calculated opening value at the step 40. The opening of the valve 200 may be controlled by connecting a motor to the rotation shaft of the engine and controlling the motor by the control unit 400. More particularly, the valve 200 may include a first worm 210 directly connected to and rotating with the rotating shaft of the motor 200, a second worm 220 moving back and forth by being engaged with the first worm 210, and a valve body 230 connected to the second worm 220.

Figure 3:
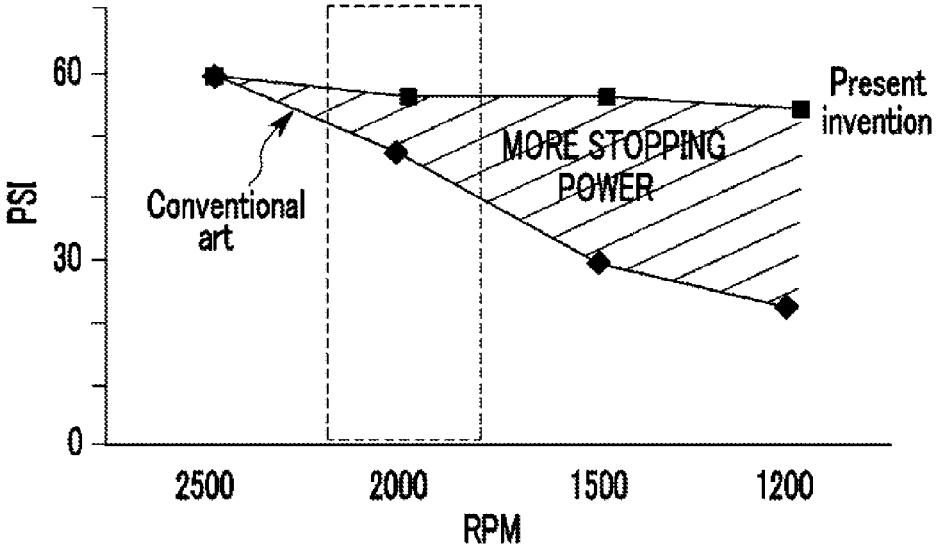
FIG. 3 is a comparison graph comparing back pressure according to the present exhaust brake and the conventional exhaust brake.

In the case of the conventional art, as shown in FIG. 3, the performance of the exhaust brake is significantly reduced at about 1500 RPM which is the mainly used rotation speed of the engine for the exhaust brake in comparison with a speed of about 2500 RPM.

However, the present invention can maintain back pressure of the exhaust brake to be constant at both rotation speeds of about 1500 RPM and 2500 RPM by changing the opening of the valve 200 according to the rotation speed of the engine. Therefore the present invention can improve the performance of the exhaust brake at about 1500 RPM which is the mainly used rotation speed of the engine in comparison with the conventional art.

The system and method for controlling an exhaust brake of a vehicle according to an exemplary embodiment of the present invention has an effect of improving performance of the exhaust brake at low and medium engine speeds, and preventing damage to the engine components by constantly maintaining back pressure of the exhaust brake at any engine speed.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for controlling an exhaust brake of a vehicle, comprising:

a measuring unit for measuring a rotation speed (RPM) of an engine;

a valve unit connected to an exhaust pipe of the engine;

an actuator connected to the valve unit and controlling an opening amount of the exhaust pipe; and a control unit for controlling the actuator to control the opening amount of the valve unit, wherein the control unit controls the actuator based on a rotation speed of the engine measured by the measuring unit, thereby maintaining back pressure of exhaust gas generated by the exhaust brake to be constant, wherein the actuator is a motor connected to the valve unit, and wherein the control unit controls the opening amount by controlling a rotation of the motor, and wherein the valve unit includes:

a first worm directly connected to and rotating with a rotating shaft of the motor;

a second worm engaged with the first worm and moving back or forth with a rotation of the first worm; and a valve body connected to the second worm and disposed at an end of the exhaust pipe to control the opening amount of the exhaust pipe by moving the valve body back and forth.

2. The system of claim 1, wherein the control unit is an electronic control unit (ECU).

3. The system of claim 1, wherein the control unit maintains the back pressure of the exhaust gas to be constant by controlling the opening amount in proportion to the rotation speed of the engine.

4. A method for controlling an exhaust brake of a vehicle, comprising:

measuring a rotation speed (RPM) of an engine;

transmitting the rotation speed of the engine to a control unit;

determining an opening amount of a valve unit which opens or closes an exhaust pipe of the engine in the control unit based on the rotation speed of the engine to maintain a back pressure of exhaust gas generated by the exhaust brake to be constant; and controlling the valve unit according to the opening amount determined by the control unit, wherein an actuator is connected to the valve unit, and wherein the control unit controls the opening amount by controlling a rotation of the actuator, and wherein the valve unit includes:

a first worm directly connected to and rotating with a rotating shaft of the actuator;

a second worm engaged with the first worm and moving back or forth by a rotation of the first worm; and a valve body connected to the second worm and disposed at an end of the exhaust pipe to control the opening amount of the exhaust pipe by moving the valve body back or forth.

5. The method of claim 4, wherein the actuator is a motor and the controlling of the valve unit is performed by controlling rotation of the motor connected to the valve unit by the control unit.

6. The method of claim 4, wherein the control unit maintains the back pressure of the exhaust gas to be constant by controlling the opening amount in proportion to the rotation speed of the engine.

* * * * *